US008082665B2

(12) United States Patent
Zimmerman et al.

(10) Patent No.: US 8,082,665 B2
(45) Date of Patent: Dec. 27, 2011

(54) APPARATUS AND METHOD SECURELY CONNECTING MATING ENDS OF MULTIPLE POWER CORDS

(76) Inventors: Stephen Edward Zimmerman, Damascus, MD (US); Thomas Carleton Shoemaker, Gaithersburg, MD (US)

( * ) Notice: Subject to any disclaimer, the term of this patent is extended or adjusted under 35 U.S.C. 154(b) by 0 days.

(21) Appl. No.: 12/662,203

(22) Filed: Apr. 6, 2010

(65) Prior Publication Data

US 2011/0244707 A1 Oct. 6, 2011

(51) Int. Cl.
*H01R 43/00* (2006.01)

(52) U.S. Cl. ..... 29/869; 29/868; 289/1.5; 439/371

(58) Field of Classification Search ..... 29/572.1, 29/854, 857, 869, 868; 439/371, 471; 361/826, 361/827; 27/572.1, 298.302; 289/1.5; 59/84, 59/92, 93

See application file for complete search history.

(56) References Cited

U.S. PATENT DOCUMENTS

| | | | | | |
|---|---|---|---|---|---|
| 1,598,309 | A | * | 8/1926 | Quinlan | 289/1.5 |
| 2,725,543 | A | * | 11/1955 | Tanner | 439/369 |
| 2,761,109 | A | | 8/1956 | Hacker | |
| 3,781,761 | A | | 12/1973 | Harwood | |
| 3,922,055 | A | | 11/1975 | McGregor | |
| 4,184,732 | A | | 1/1980 | Hudson | |
| 4,514,026 | A | * | 4/1985 | Herbert | 439/297 |
| 4,690,476 | A | * | 9/1987 | Morgenrath | 439/502 |
| 4,773,874 | A | | 9/1988 | Kopeski | |
| 4,898,542 | A | * | 2/1990 | Jones, Jr. | 439/371 |
| 4,927,377 | A | * | 5/1990 | Bach et al. | 439/367 |
| 5,728,109 | A | * | 3/1998 | Schulze et al. | 606/139 |
| 5,752,848 | A | * | 5/1998 | Youngmark | 439/369 |
| 5,997,051 | A | * | 12/1999 | Kissner et al. | 289/1.5 |
| 6,033,251 | A | * | 3/2000 | Cook | 439/369 |
| 6,099,341 | A | * | 8/2000 | Shymko | 439/371 |
| 7,431,606 | B2 | | 10/2008 | Hartrich | |

OTHER PUBLICATIONS

Davis et al., Knots and Rope, 1946, Science Service Inc., Washington Infantry Journal Press, pp. 50-51.*

Ashley, Clifford, The Ashley Book of Knots, 1944, Doubleday Dell Publishing Co.*

* cited by examiner

*Primary Examiner* — Derris Banks
*Assistant Examiner* — Jeffrey T Carley
(74) *Attorney, Agent, or Firm* — Merek, Blackmon & Voorhees, LLC

(57) ABSTRACT

An apparatus for securely connecting mating ends of two power cords to prevent the mating ends of the two power cords from inadvertently or accidentally detaching from each other. The apparatus includes a flexible connector having a center segment, a first end and a second end. A preferred form of the flexible connector can readily accommodate varying configurations of mating ends of power cords. Preferably, the flexible connector is substantially symmetrical to facilitate installation. The first end has a first opening and the second end has a second opening. The center segment, the first end and the second end are manipulable to form a first retaining member and a second retaining member for securing a first end of a first power cord to a first end of a second power cord. Preferably, the flexible connector is configured such that it may not be inadvertently or accidentally dislodged from the first power cord or the second power cord. The first retaining member is adapted to receive the first end of the first power cord. The second retaining member is adapted to receive the first end of the second power cord. Preferably, the first retaining member and the second retaining member are adjustable.

8 Claims, 3 Drawing Sheets

APPARATUS AND METHOD SECURELY CONNECTING MATING ENDS OF MULTIPLE POWER CORDS

FIELD OF THE INVENTION

A preferred form of the present invention relates to an apparatus and method of maintaining the connection between mating ends of a first power cord and a second power cord to prevent inadvertent and/or accidental disconnection of the mating ends of the two power cords. More particularly, a preferred form of the present invention relates to an apparatus and method of maintaining the connection between mating ends of a power cord without any modification to the structure of any power cord.

BACKGROUND OF THE INVENTION

Extension cords are widely used in numerous commercial fields. Extension cords are also widely used in numerous residential environments. It is quite common to connect two or more power cords to run power from a power source to a power tool or any other device that operates on electricity. This connection must be maintained to be able to continue to operate the power tool or other device. The connection between mating ends of two power cords may become inadvertently or accidentally disconnected in a number of different ways to the dismay of the individual operating the power tool or other device running on electricity.

In an effort to prevent the inadvertent or accidental disconnection of mating ends of two power cords, a number of devices have been developed including those disclosed in U.S. Pat. Nos. 7,431,606; 2,761,109; 3,781,761; 3,922,055; 4,184,732; 4,773,874; and, 5,514,004. However, prior devices have numerous disadvantages. For example, a number of prior devices cannot readily accommodate power cords where the mating ends vary in configuration, i.e., the device is specific to a particular configuration of the mating ends. Other devices are relatively complex and/or expensive. Yet, other devices are difficult to install or remove. Still other devices can become dislodge from the power cords thereby rendering the device ineffective. Therefore, there is a need for a device that prevents the disconnection of mating ends of two power cords that overcomes the aforementioned articulated disadvantages as well as other disadvantages not recited above.

OBJECTS AND SUMMARY OF THE INVENTION

An object of a preferred embodiment of the present invention is to provide a novel and unobvious apparatus and method for securely connecting mating ends of two power cords to prevent the mating ends of the two power cords from inadvertently or accidentally detaching from each other.

Another object of a preferred embodiment of the present invention is to provide an apparatus for securely connecting mating ends of two power cords to prevent the mating ends of the two power cords from inadvertently detaching from each other where the apparatus can readily accommodate varying configurations of mating ends.

A further object of a preferred embodiment of the present invention is to provide an apparatus for securely connecting mating ends of two power cords to prevent the mating ends of the two power cords from inadvertently detaching from each other where the apparatus can be easily and readily installed on and removed from the two power cords.

Still a further object of a preferred embodiment of the present invention is to provide an apparatus for securely connecting mating ends of two power cords to prevent the mating ends of the two power cords from inadvertently detaching from each other where the apparatus is substantially symmetrical to facilitate installation of the apparatus on the two power cords.

Yet still another object of a preferred embodiment of the present invention is to provide an apparatus for securely connecting mating ends of two power cords to prevent the mating ends of the two power cords from inadvertently detaching from each other where the apparatus can be readily converted to a storage device for facilitating storage of one or more power cords.

Yet another object of a preferred embodiment of the present invention is to provide an apparatus for securely connecting mating ends of two power cords to prevent the mating ends of the two power cords from inadvertently detaching from each other where the apparatus is simple and relatively in expensive to manufacture.

Still a further object of a preferred embodiment of the present invention is to provide an apparatus for securely connecting mating ends of two power cords to prevent the mating ends of the two power cords from inadvertently detaching from each other where the apparatus cannot be inadvertently or accidentally dislodged from the two power cords.

Another object of a preferred embodiment of the present invention is to provide apparatus for securely connecting mating ends of two power cords to prevent the mating ends of the two power cords from inadvertently detaching from each other where the apparatus includes a single strand of non-conductive material that can be readily manipulated to form one or more retaining members.

Yet another object of a preferred embodiment of the present invention is to provide apparatus for securely connecting mating ends of two power cords to prevent the mating ends of the two power cords from inadvertently detaching from each other where the apparatus includes a single strand of non-conductive material that can be readily manipulated to form one or more adjustable retaining loops.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to an apparatus for securely connecting mating ends of two power cords to prevent the mating ends of the two power cords from inadvertently detaching from each other. The apparatus includes a flexible connector having a center segment, a first end and a second end. The first end of the flexible connector has a first opening. The second end of the flexible connector has a second opening. The first opening is configured to permit the second end and a portion of the center segment to be inserted through the first opening to form a first retaining member. The second opening is configured to permit the first retaining member to be inserted through the second opening to form a second retaining member.

Another embodiment of the present invention is directed to an apparatus for securely connecting mating ends of two power cords to prevent the mating ends of the two power cords from inadvertently detaching from each other. The apparatus includes a flexible connector having a center segment, a first end and a second end. The first end has a first opening and the second end has a second opening. The center segment, the first end and the second end are manipulable to form a first adjustable retaining member and a second adjustable retaining member for securing a first end of a first power cord to a first end of a second power cord. The first adjustable retaining member is adapted to receive the first end of the first power cord. The second adjustable retaining member is adapted to receive the first end of the second power cord.

A further embodiment of the present invention is directed to a method of securely connecting mating ends of two power cords to prevent the mating ends of the two power cords from inadvertently detaching from each other. The method includes the steps of: (a) providing a flexible connector having a center segment, a first end and a second end, the first end of the flexible connector having a first opening and the second end of the flexible connector having a second opening; (b) inserting the second end and a portion of the center segment through the first opening in the first end of the flexible connector to form a first adjustable loop; and, (c) inserting the first adjustable loop through the second opening in the second end of the flexible connector to form a second adjustable loop.

DETAILED DESCRIPTION OF THE PREFERRED EMBODIMENTS OF THE INVENTION

Figure 1:
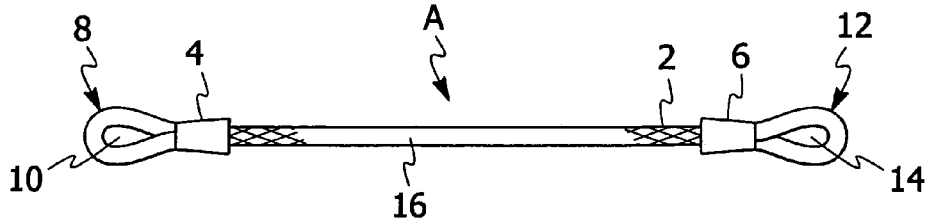
FIG. 1 is a plan view of a flexible connector formed in accordance with a preferred embodiment of the present invention.

The most preferred forms of the invention will now be described with reference to FIGS. 1-9. The appended claims are not limited to the most preferred forms and no term used herein is to be given a meaning other than its ordinary meaning unless expressly stated otherwise.

FIGS. 1 Through 9

Referring to FIGS. 1 to 5, a flexible connector A for securely connecting mating ends of two power cords to prevent the mating ends of the two power cords from inadvertently detaching from each other is illustrated in one of many possible configurations. Flexible connector A is formed from a non-conductive material and is substantially symmetrical. Preferably, flexible connector A is approximately 8½ inches to 8¾ inches in length. However, the length may be readily varied as needed. In its most preferred form, flexible connector A is formed from a single strand of rope 2 and two anchors or fasteners 4 and 6. Preferably, anchors or fasteners 4 and 6 are formed from a non-conductive material such as plastic or nylon. It should be noted that the anchors are not limited to plastic or nylon. Rather, any suitable material may be used.

Anchor 4 joins two portions of strand 2 to form a first end 8 of flexible connector A. Preferably, first end 8 is approximately 1½ inches to 1¾ inches in length. However, the length may be readily varied as needed. First end 8 of flexible connector A is preferably in the form of a fixed loop having an opening 10. Because the first end 8 is preferably fixed, the size of the opening 10 is fixed, i.e., not adjustable. Anchor 6 joins two other portions of strand 2 to form a second end 12 of flexible connector A. Preferably, second end 12 is approximately 1½ inches to 1¾ inches in length. However, the length may be readily varied as needed. Second end 12 of flexible connector A is preferably in the form of a fixed loop having an opening 14. Because the second end 12 of flexible connector A is preferably fixed, the size of the opening 14 is fixed, i.e., not adjustable.

A center segment 16 of strand 2 connects first end 8 to second end 12. Preferably, center segment 16 forms a major portion of flexible connector A. While rope is the preferred non-conductive material for strand 2, it will be readily appreciated that any other suitable material may be used. It should be further noted that anchors 4 and 6 may be omitted. For example, a flexible connector could be formed through a molding process that is substantially as shown in FIG. 1 with the exception of anchors 4 and 6, i.e., a center segment connecting a first looped end to a second looped end.

Figure 5:
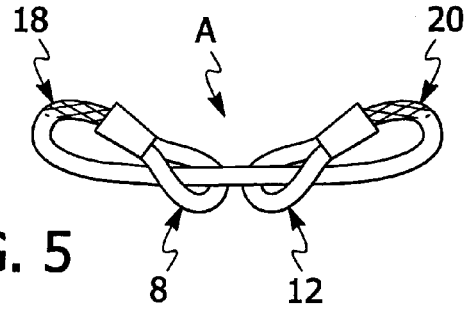
FIG. 5 is a plan view of the flexible connector depicted in FIG. 4 further manipulated to form a second adjustable loop.

Referring to FIG. 5, center segment 16, first end 8 and second end 12 are manipulable to form two adjustable retaining loops 18 and 20. The size of the retaining loops 18 and 20 may be readily varied by merely sliding the corresponding end (either first end 8 or second end 12) along the center segment 16. Specifically, by moving first end 8 towards second end 12 the size of adjustable retaining loop 18 will increase. Conversely, by moving first end 8 away from second end 12, the size of adjustable retaining loop 18 will decrease. By moving second end 12 towards first end 8, the size of adjustable retaining loop 20 will increase. Conversely, by moving second end 12 away from first end 8, the size of adjustable retaining loop 20 will decrease.

Figure 6:
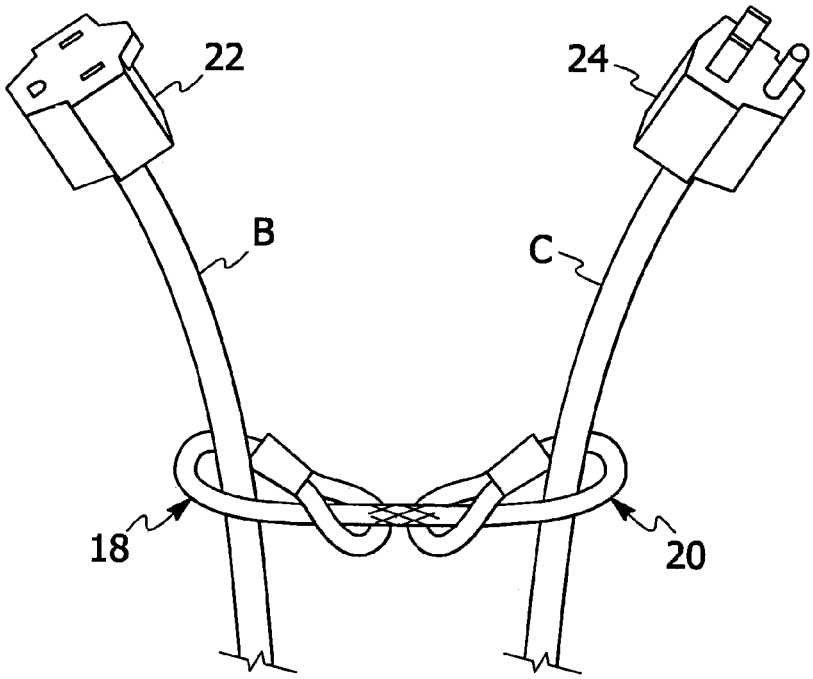
FIG. 6 is a perspective view of the flexible connector depicted in FIG. 5 installed on two power cords.
Figure 7:
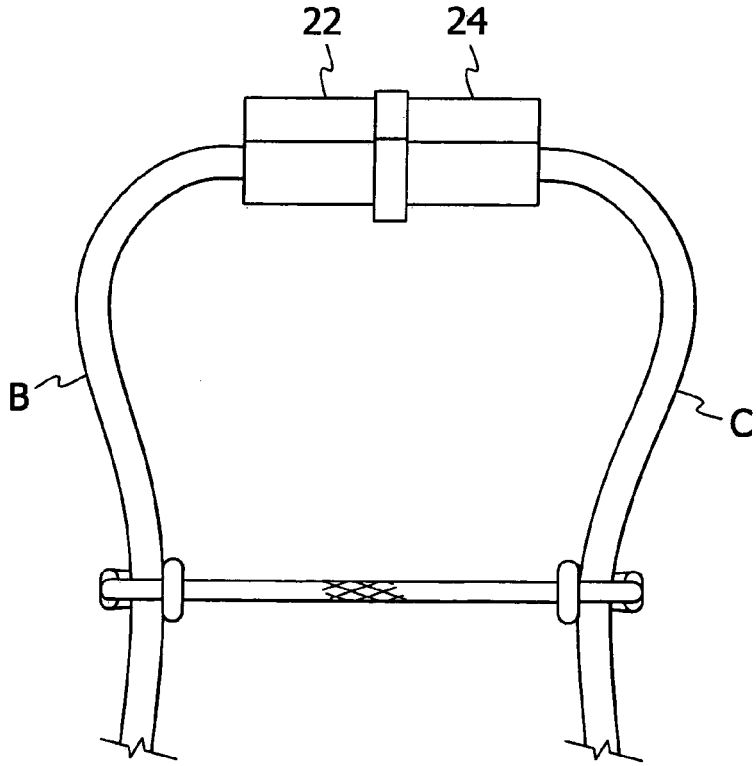
FIG. 7 is a plan view of the flexible connector with the two adjacent ends of the power cords connected and the first and second adjustable loops tightened.
Figure 8:
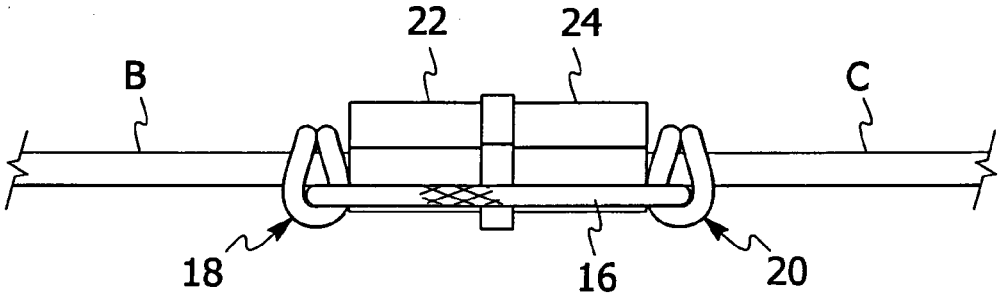
FIG. 8 is a fragmentary plan view of the flexible connector installed in its operating position on two power cords.

Referring to FIG. 6, a first mating end 22 of a first power cord B is inserted through retaining loop 18. Because retaining loop 18 is adjustable it can readily accommodate different size and shaped mating ends of power cords. A first mating end 24 of a second power cord C is inserted through retaining loop 20. Because retaining loop 20 is adjustable it can readily accommodate different sizes and shapes of mating ends of power cords. Mating end 22 and mating end 24 are subsequently connected to each other. Referring to FIG. 7, some of the slack in retaining loops 18 and 20 may be taken up prior to moving flexible connector A to its operating position shown in FIG. 8. Alternatively, flexible connector A may be moved to its operating position without any slack being taken up. Subsequently, when in or adjacent its operating position all of the slack in retaining loops 18 and 20 is taken up so that mating ends 22 and 24 are securely connected to each other. To remove flexible connector A from power cords B and C, retaining loops 18 and 20 are adjusted to become larger so that the corresponding mating end of a power cord can be drawn through the corresponding adjustable loop after the mating end of one power cord has been disconnected from the other mating end of the other power cord.

Figure 2:
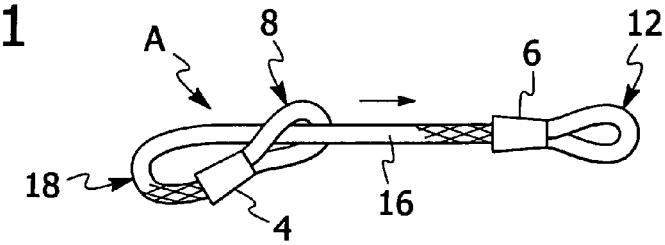
FIG. 2 is a plan view of the flexible connector depicted in FIG. 1 manipulated to form a first adjustable retaining loop.
Figure 3:
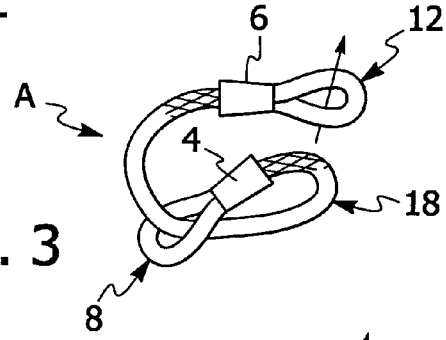
FIG. 3 is a plan view of the flexible connector depicted in FIG. 2 further manipulated such that the first adjustable loop is aligned with a fixed loop of the flexible connector.
Figure 4:
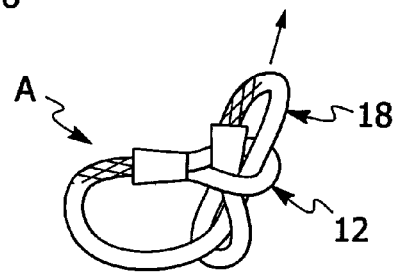
FIG. 4 is a plan view of the flexible connector depicted in FIG. 3 further manipulated such that the first adjustable loop is partially inserted in a fixed loop of the flexible connector.

The manner in which first end 8, second end 12 and center segment 16 are manipulated so that flexible connector A can take the form illustrated in FIG. 5 will now be described with reference to FIGS. 1 to 5. As seen in FIGS. 1 and 2, second end 12 and a portion of center segment 16 is inserted through opening 10 in first end 8 to form first adjustable retaining loop 18. As seen in FIGS. 3 to 5, adjustable retaining loop 18 is then aligned with and insert through opening 14 in second end 12 to form second adjustable loop 20. It should be noted that because flexible connector A is substantially symmetrical, one can achieve a similar construction by inserting first end 8 through second end 12 to form a first adjustable loop and subsequently inserting the first adjustable loop through first end 8 to form the second adjustable loop. Therefore, an individual does not have to concern himself or herself with which end of flexible connector A to use as a starting point. This feature will facilitate installation of flexible connector A on power cords B and C.

Figure 9:
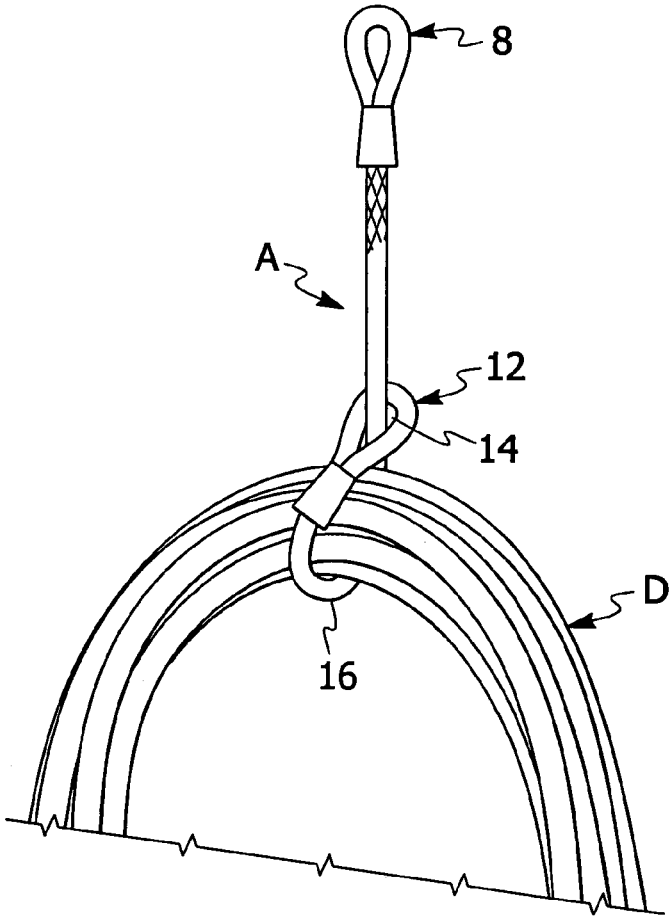
FIG. 9 is a fragmentary elevation view illustrating how the flexible connector can be readily converted to a storage device.

Referring to FIG. 9, flexible connector A can be readily converted to a storage device to store one or more power cords. Specifically, center segment 16 may be wrapped around a coiled power cord D and first end 8 inserted through opening 14 in second end 12. First end 8 can then be placed over a nail or other hanging member to store power cord D where desired when not in use. It should be noted that due to the symmetrical nature of flexible connector A, second end 12 may be inserted through opening 10 in first end 8 to form the storage device.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A method of securely connecting mating ends of two power cords to prevent the mating ends of the two power cords from inadvertently detaching from each other, said method including the steps of:

(a) providing a flexible connector having a center segment, a first end and a second end, said first end of said flexible connector having a first opening and said second end of said flexible connector having a second opening;

(b) inserting said second end and a portion of said center segment through said first opening in said first end of said flexible connector to form a first adjustable loop;

(c) inserting said first adjustable loop through said second opening in said second end of said flexible connector to form a second adjustable loop; and (d) inserting a first end of a power cord into said first adjustable loop.

2. A method of securely connecting mating ends of two power cords to prevent the mating ends of the two power cords from inadvertently detaching from each other, said method including the steps of:

(a) providing a flexible connector having a center segment, a first end and a second end, said first end of said flexible connector having a first opening and said second end of said flexible connector having a second opening;

(b) inserting said second end and a portion of said center segment through said first opening in said first end of said flexible connector to form a first adjustable loop;

(c) inserting said first adjustable loop through said second opening in said second end of said flexible connector to form a second adjustable loop;

(d) inserting a first end of a first power cord into said first adjustable loop; and, (e) adjusting said first adjustable loop so that the first end of said first power cord is secured to said flexible connector.

3. A method as recited in claim 2, including the further steps of:

(a) inserting a first end of a second power cord into said second adjustable loop; and, (b) adjusting said second adjustable loop so that said first end of said second power cord is secured to said flexible connector.

4. A method as recited in claim 3, further including the step of:

(a) mating said first end of said first power cord to said first end of said second power cord.

5. A method as recited in claim 4, wherein:

(a) in claim 4 is performed prior to step (e) in claim 2 and step (b) in claim 3.

6. A method of securely connecting mating ends of two power cords to prevent the mating ends of the two power cords from inadvertently detaching from each other, said method including the steps of:

(a) providing a flexible connector having a center segment, a first end and a second end, said first end of said flexible connector having a first opening and said second end of said flexible connector having a second opening;

(b) inserting said second end and a portion of said center segment through said first opening in said first end of said flexible connector to form a first adjustable loop;

(c) inserting said first adjustable loop through said second opening in said second end of said flexible connector to form a second adjustable loop;

(d) said flexible connector is substantially symmetrical about a midpoint of said center segment;

(e) said flexible connector is adapted to readily convert to a storage device for storing at least one coiled power cord; and, (f) mating a first end of a first power cord to a first end of a second power cord.

7. A method as recited in claim 1, further including the step of:

(a) inserting a first end of a second power cord into said second adjustable loop.

8. A method recited in claim 6, further including the steps of:

(a) adjusting said first adjustable loop so that the first end of said first power cord is secured to said flexible connector; and, (b) adjusting said second adjustable loop so that said first end of said second power cord is secured to said flexible connector.

* * * * *

UNITED STATES PATENT AND TRADEMARK OFFICE

CERTIFICATE OF CORRECTION

PATENT NO. : 8,082,665 B2
APPLICATION NO. : 12/662203
DATED : December 27, 2011
INVENTOR(S) : Stephen Edward Zimmerman and Thomas Carleton Shoemaker It is certified that error appears in the above-identified patent and that said Letters Patent is hereby corrected as shown below:

Claim 1, line 49, "adjustable loop; and" should be – adjustable loop; and, –

Claim 5, line 23, "(a) in claim 4" should be – (a) step (a) in Claim 4 –

Signed and Sealed this
Sixth Day of March, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,082,665 B2
APPLICATION NO. : 12/662203
DATED : December 27, 2011
INVENTOR(S) : Stephen Edward Zimmerman and Thomas Carleton Shoemaker It is certified that error appears in the above-identified patent and that said Letters Patent is hereby corrected as shown below:

Claim 1, Column 5, line 49, "adjustable loop; and" should be -- adjustable loop; and, --

Claim 5, Column 6, line 23, "(a) in claim 4" should be -- (a) step (a) in Claim 4 --

This certificate supersedes the Certificate of Correction issued March 6, 2012.

Signed and Sealed this
Third Day of April, 2012

David J. Kappos

David J. Kappos
*Director of the United States Patent and Trademark Office*